United States Patent [19]

Dominy et al.

[11] 4,214,768

[45] Jul. 29, 1980

[54] SHIELD FOR SKATEBOARD TRUCK AXLE HOUSING

[75] Inventors: David A. Dominy, Cardiff; Gary M. Dodds, Encinitas, both of Calif.

[73] Assignee: Tracker Designs, Ltd, San Diego, Calif.

[21] Appl. No.: 950,271

[22] Filed: Oct. 10, 1978

[51] Int. Cl.[2] ..... A63C 3/00

[52] U.S. Cl. ..... 280/809; 280/11.1 R; 280/87.04 A

[58] Field of Search ..... 280/11.37 M, 11.37 E, 280/11.1 R, 87.04 A, 11.19, 11.2, 11.21, 11.22, 11.23, 11.25, 11.26, 11.27, 11.28

[56] References Cited

U.S. PATENT DOCUMENTS

| | | | |
|---|---|---|---|
| 2,245,769 | 6/1941 | Flamm | 280/11.19 |
| 2,405,000 | 7/1946 | Whited | 280/11.37 E |
| 2,505,154 | 4/1950 | Smith | 280/11.22 X |

*Primary Examiner*—John J. Love
*Assistant Examiner*—Milton L. Smith
*Attorney, Agent, or Firm*—Duane C. Bowen

[57] ABSTRACT

In a skateboard truck with a central depending axle housing having extending to each side an axle on which a wheel is disposed and secured by a nut, a protective plastic shield covering the lowest portion of the housing and extending substantially from wheel to wheel. The shield is secured in place by a washer on each side disposed on the axle inside of the wheel and having a first flange fitting the end of the housing and having a second flange receiving a generally semicircular, reduced-diameter adjacent end of the shield.

7 Claims, 6 Drawing Figures

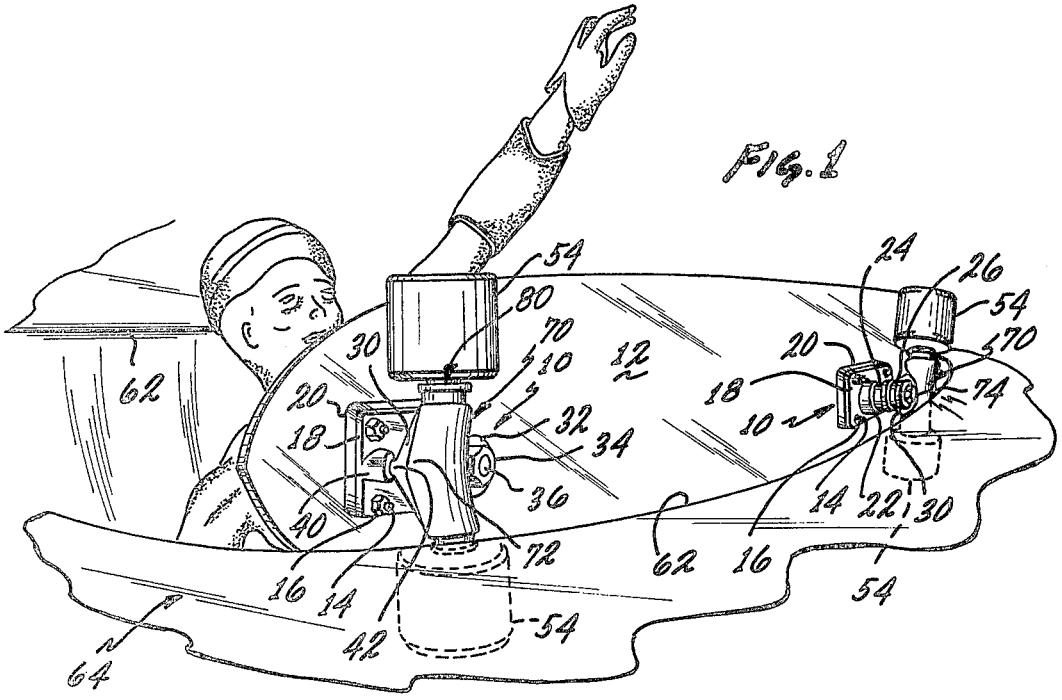
FIG. 1
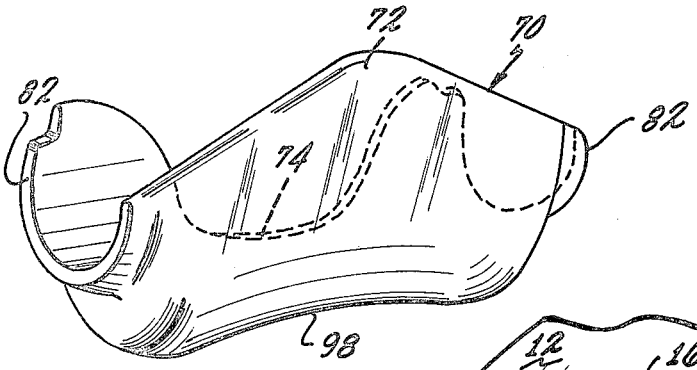
FIG. 2
FIG. 5
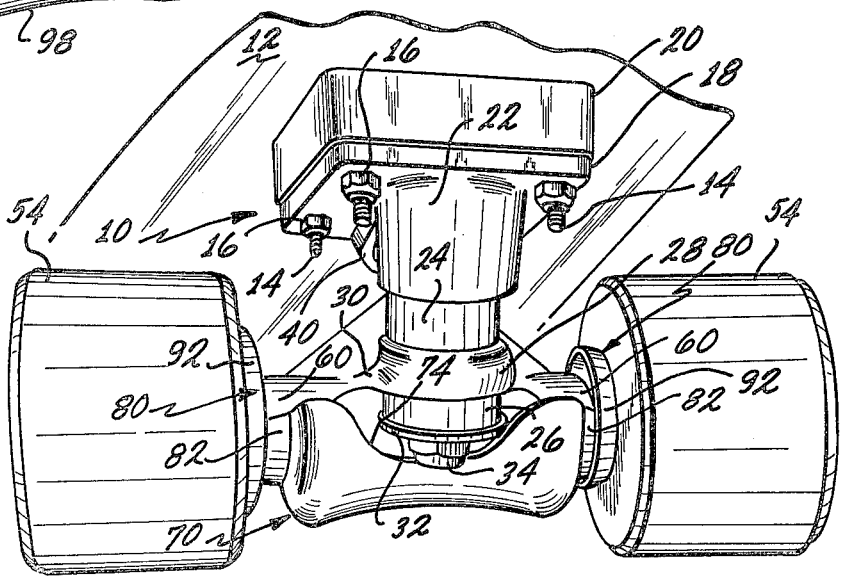

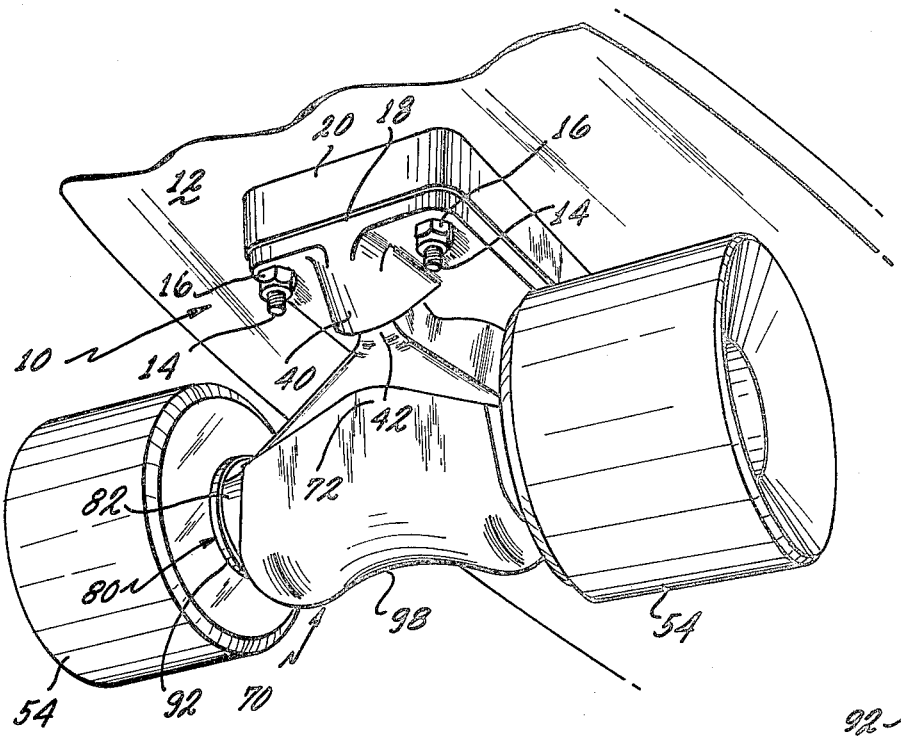
Fig. 3
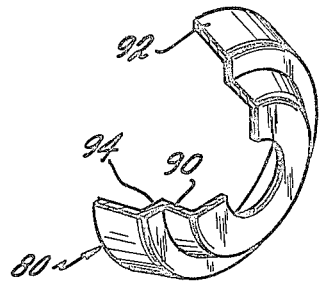
Fig. 6
Fig. 4
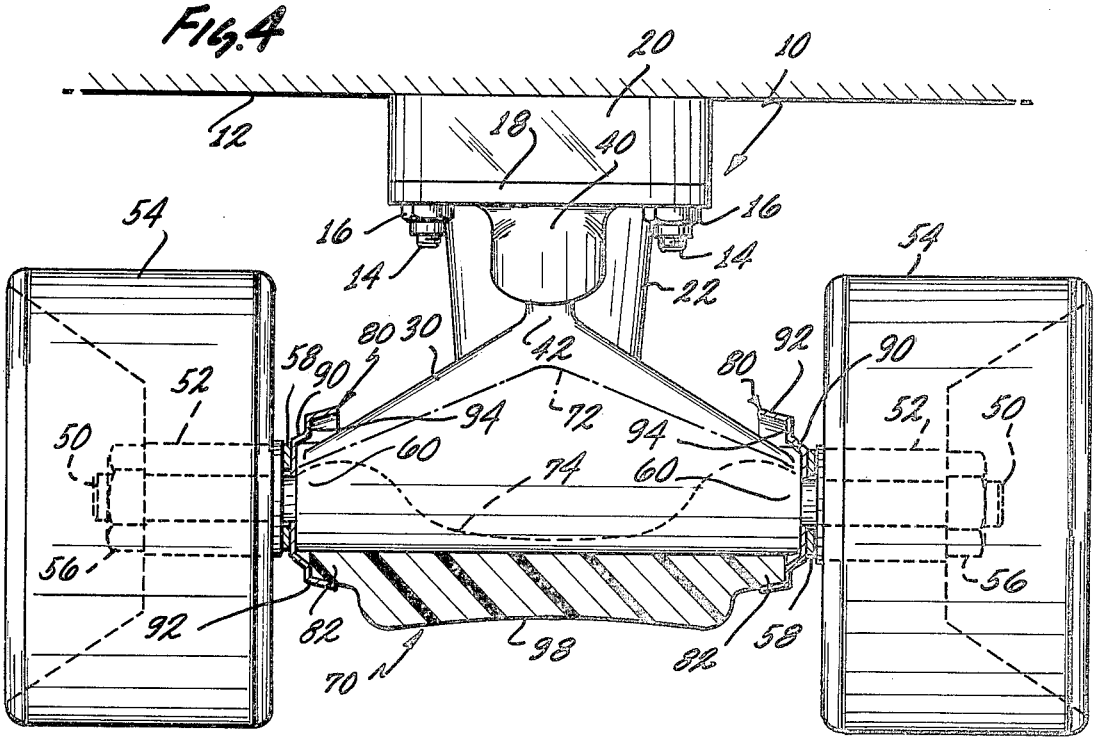

SHIELD FOR SKATEBOARD TRUCK AXLE HOUSING

CONCISE SUMMARY OF INVENTION AND OBJECTIVES

Our invention relates to means to shield the under surfaces of axle housings in skateboard trucks.

With the advent of polyurethane wheels for skateboards, of skateboard parks, etc., the feats, techniques, etc., of experienced users on skateboards have multiplied and the skill levels have greatly increased. One problem in some skateboard riding has been wearing of the underside of the skateboard truck axle housings by the edges of concrete pools, curbs and similar objects in parks. Such contact of such concrete edges can be deliberate or accidental. If a shield is provided adapted to permit such concrete edge contacts without axle housing wear, it is believed there will be more riding techniques developed using contact of such edges between the wheels of skateboard trucks.

The objectives of our invention include to solve such problems of wear on truck axle housings, to provide an economical solution, and to provide a replaceable item so that lives of skateboard trucks will be lengthened. A further objective is to develop such shielding means that will permit increased contact of concrete edges between skateboard wheels in riding techniques, events, etc.

Our invention will be best understood, together with additional objectives and advantages thereof, from the following description, read with reference to the drawing, in which:

FIG. 1 is a perspective view of a skateboard in use such as in a skateboard park or in a swimming pool wherein a housing supporting a truck axle drags on the edge of the pool or the like and is worn. The view shows a specific embodiment of our invention, which concerns a protective shield installed on the housing to protect against wear on the housing.

FIG. 2 is an enlarged perspective view of the inboard side of a truck, viewed from below.

FIG. 3 is a view like FIG. 2 but of the outboard side.

FIG. 4 is an enlarged elevational view of the outboard side of a truck, with the shield and its mounting washers shown in section.

FIG. 5 is a perspective view of the shield per se.

FIG. 6 is a perspective view of a washer used to secure the shield in place, part of the washer being cut away to better reveal the structure.

Before dealing specifically with the invention, we will first describe the skateboard truck parts shown. The trucks 10 depicted are more or less typical of those on the market. Trucks 10 are secured to the skateboard plateform 12 by countersunk bolts 14, secured by aircraft-quality locknuts 16, that extend through the truck base plate 18 and a spacing pad 20. The inboard side of base plate 18 has a boss 22. An inner grommet 24 and an outer grommet 26 are formed of elastomeric material and sandwich a ring 28 which is part of the casting forming axle housing 30. Housing 30 usually is formed as a metal casting but substitution of a plastic molding some time in the future is a possibility. The assembly is secured together by a washer 32 and a tension-adjustment locknut 34 installed on threaded rod end 36.

The other end of base plate 18 has a pivot boss 40 in which is engaged a pivot 42 which is part of axle housing 30. The axle housing 30 supports axle means which usually is a single rod-shaped member threaded on each end 50 and secured in a passageway through housing 30, although instead a pair of stub axles could be secured in housing 30. Axle 50 receives bearing means 52 supporting wheels 54 which currently are usually made of dense polyurethane foam. Wheels 54 are secured in place on axle 50 by locknuts 56 and washers 58 are disposed between bearings 52 and the adjacent ends 60 of casting 30.

It will be understood that the bottom central portion of axle housing 30 is subject to abrasion by the concrete edges 62 of pools 64 or by like edges on riding surfaces in skateboard parks or by the curb edges of streets, etc. An experienced skateboard user can wear casting 30 down to the axle passageway and into the axle itself (and also wear off the end of tension bolt member 36, etc.).

Turning now to the present invention, a protective shield 70 is provided covering the surfaces of axle housing 30 subject to wear from surfaces such as pool edges 62 or the like. Shield 70 preferably is made of a thermoset plastic, with or without fiber reinforcement. A polypropylene or an acetal resin can have especially good wearing characteristics. The plastic presently being used is Delrin 500, an acetal resin manufactured by du Pont. Another material may be substituted if a satisfactory lower priced material is discovered, and polypropylene plastics will be investigated, for example. By "plastic" we mean to include rubbers, should an applicable rubber be developed.

In the preferred shape, shield 70 extends in vee-manner 72 toward pivot 42 but has bifurcated relief 74 on the side of casting 30 toward ring 28 to accommodate grommet 26, washer 32, etc. At this maximum thickness, shield 70 had a thickness around $\frac{3}{8}''$ in prototypes. This means that shield 70 can wear most of $\frac{3}{8}''$ before replacement is required.

Adequate securement of shield 70 but ready replacement are important, as trucks 10 will survive many replacement sheilds 70. We secure shield 70 by use of a special annularly flanged washer 80 and by conforming ends 82 on shield 70. Ends 82 are reduced in thickness to be received within washer 80. Shield ends 82 have end profiles that are annular throughout more than 180 degrees. The workability of the securing system is partly dependent on the shapes of the ends 60 of housing 30 which are annular to fit within the flanged annular washer 80 and to match the semiannular configurations of shield ends 82.

Washer 80 fits on axle 50 inside of washer 58 and has a first annular flange 90 generally fitting or accommodating ends 60 of housing 30. If flange 90 flares inwardly of axle 50, as shown, note it will make positive contact with casting ends 60 even if they differ somewhat in diameter within the limits of maximum and minimum inside diameters of flange 90. A second flange 92 on washer 80, joined to flange 90 by an annular web 94, also preferably flares inwardly, although the flare does not need to be pronounced as in the case of flange 90, i.e., flange 92 accommodates tolerances in manufacture of shield 70 but flange 90 accommodates differences in the sizes of casting ends 60 which tend to involve larger tolerances. Note that when the wheel assemblies are tensed (by adjustment of nut 56 on axle 50), shield 70 is secured by wedging of casting ends in flanges 90 and by wedging of shield ends 82 within annular flanges 92.

Also important to the securement of shield 70 is the fact that in cross-section longitudinally of the skateboard, the inner surface of pad 70 is U- or V-shaped to conform to the inboard and outboard surfaces of axle housing 30 upon which shield 70 is installed, which prevents shield 70 from having a turning moment relative to the axle 50. Shield 70 may have more than one size, i.e., a width between wheels 54 suitable for a truck 10 of normal width and a wider width for trucks with wide-spaced wheels.

The surface of shield 70 can be given a central depression 98, i.e., a saddle-shape across truck 10, guidance of truck 10 on a rim or curb 62. Note that it is not always by accident that truck 10 between wheels 54 rides on an edge such as 62. Instead, such action can be deliberate, so that providing a saddle 98 to facilitate such edge guiding or riding action has a functional purpose. Note, also, that once a truck can be ridden on such an edge 62 without damage to the truck, skateboard users may find more occasions (tricks, riding techniques, etc.) to utilize the protection of shield 70, in which case the guidance of central depression 98 may be especially advantageous.

Having thus described our invention, we do not wish to be understood as limiting ourselves for the exact construction shown and described. Instead, we wish to cover those modifications of our invention that will occur to those skilled in the art upon learning of our invention and which are within the proper scope thereof.

We claim:

1. In a truck for a skateboard or the like with a central depending axle housing having extending to each side thereof an axle on which a wheel is disposed and secured thereon by a nut, means to protect the bottom of said housing, comprising:

(a) a shield covering the bottom of said axle housing substantially from end to end thereof, (b) means securing said shield in place on said housing, and (c) the lower surface of said shield having a central depression so the depression can guide on a conrete edge surface.

2. The subject matter of claim 1 in which said central depression gives said shield a saddle shape in profile laterally of the truck.

3. In a truck for a skateboard or the like with a central depending axle housing having extending to each side thereof an axle on which a wheel is disposed and secured thereon by a nut, means to protect the bottom of said housing, comprising:

(a) a shield covering the bottom of said axle housing substantially from end to end thereof, (b) means securing said shield in place on said housing, and (c) said shield being made of plastic and said means securing said shield in place including an annular member lapping each end of said shield adjacent to said wheels.

4. In a truck for a skateboard or the like with a central depending axle housing extending to each side thereof an axle on which a wheel is disposed and secured thereon by a nut, means to protect the bottom of said housing, comprising:

(a) a shield covering the bottom of said axle housing substantially from end to end thereof, (b) means securing said shield to place on said housing, and (c) said means securing said shield in place being a washer on said axle at each end of said housing having a first annular flange fitting the adjacent end of said housing and a second larger diameter annular flange connected to said first flange by an annular web and lapping the adjacent end of said shield to hold the same in place.

5. The subject matter of claim 4 in which said shield is made of plastic and said shield has reduced diameter, generally semi-annular ends fitting in said second annular flange.

6. The subject matter of claim 5 in which said annular flanges flare inwardly of said truck so as to grip said ends of said housing and to grip said ends of said shield to secure said shield to said housing in a wedged manner upon compression of said washers in the assembly between said wheels.

7. The subject matter of claim 6 in which the inner surface of said shield longitudinally of said skateboard has generally a vee outline to fit the generally vee sectional outline of said axle housing.

* * * * *